US011572787B2

(12) United States Patent
Pellissier

(10) Patent No.: US 11,572,787 B2
(45) Date of Patent: Feb. 7, 2023

(54) METHOD FOR RENOVATING, REPAIRING, REINFORCING, PROTECTING OR NEWLY CREATING CORRUGATED METAL-SHEET TUNNELS, AND CORRUGATED METAL-SHEET TUNNELS OF THIS TYPE

(71) Applicant: S&P CLEVER REINFORCEMENT COMPANY AG, Seewen (CH)

(72) Inventor: Etienne Pellissier, Bulle (CH)

(73) Assignee: S&P CLEVER REINFORCEMENT COMPANY AG, Seewen (CH)

( * ) Notice: Subject to any disclaimer, the term of this patent is extended or adjusted under 35 U.S.C. 154(b) by 0 days.

(21) Appl. No.: 17/046,048

(22) PCT Filed: Apr. 4, 2019

(86) PCT No.: PCT/EP2019/058485
§ 371 (c)(1),
(2) Date: Oct. 8, 2020

(87) PCT Pub. No.: WO2019/197265
PCT Pub. Date: Oct. 17, 2019

(65) Prior Publication Data

US 2021/0032990 A1 Feb. 4, 2021

(30) Foreign Application Priority Data

Apr. 10, 2018 (CH) ..... 00457/18

(51) Int. Cl.
*E01F 5/00* (2006.01)
*E21D 11/10* (2006.01)
*E21D 11/14* (2006.01)

(52) U.S. Cl.
CPC ..... *E21D 11/10* (2013.01); *E01F 5/005* (2013.01); *E21D 11/107* (2013.01); *E21D 11/14* (2013.01)

(58) Field of Classification Search
CPC ..... E21D 11/10; E21D 11/107; E21D 11/14; E01F 5/005
See application file for complete search history.

(56) References Cited

U.S. PATENT DOCUMENTS 2,096,850 A * 10/1937 Forsberg ..... E21D 11/10 405/150.1
3,545,213 A * 12/1970 Hofbauer ..... E21D 11/10 405/150.2

(Continued)

FOREIGN PATENT DOCUMENTS

CN 104213515 A 12/2014
CN 104895581 B 3/2017
EP 1245547 A1 * 10/2002 ..... C04B 28/02

OTHER PUBLICATIONS

Bischof, Patrick et al., "Retrofitting Masonry Walls with Carbon Mesh"; Jan. 27, 2014, All (Year: 2014).*

(Continued)

*Primary Examiner* — Benjamin F Fiorello
(74) *Attorney, Agent, or Firm* — Polsinelli PC

(57) ABSTRACT

A process is used for the renovation or new construction of corrugated sheet metal tunnels. The corrugated sheets are sandblasted for cleaning and room cleaning. Then anchoring elements are welded to the rough side of the sheets. A layer of shotcrete is applied to this roughened side of the sheets to obtain a smooth coating over the crests and valleys of the sheets. A reinforcement net is placed on this layer and a second layer of shotcrete or mortar is applied to cover the reinforcement net. The top layer can be smoothed. The subsequent corrugated sheet metal tunnel includes corrugated sheets covering the tunnel walls and ceilings with the course direction of their wave crests and valleys parallel to the circumferential direction of the tunnel profile. The (Continued)

corrugated sheets on the inside and/or outside of the tunnel are reinforced with an applied reinforced concrete layer.

18 Claims, 6 Drawing Sheets

(56) References Cited

U.S. PATENT DOCUMENTS

| | | | | |
|---|---|---|---|---|
| 4,260,297 | A * | 4/1981 | Houston | E21D 11/40 405/303 |
| 4,390,306 | A | 6/1983 | Fisher | |
| 5,833,394 | A | 11/1998 | McCavour | |
| 6,193,439 | B1 * | 2/2001 | Wolfseher | E21D 11/383 405/150.2 |
| 6,761,504 | B1 * | 7/2004 | Brandenberger | E21F 16/02 405/150.2 |
| 8,220,220 | B2 * | 7/2012 | Kim | E21D 11/155 52/745.07 |
| 2009/0214297 | A1 | 8/2009 | Wilson | |

OTHER PUBLICATIONS

International Search Report and Written Opinion of PCT/EP2019/058485 dated Aug. 1, 2019.

Translation of International Search Report of PCT/EP2019/058485 dated Aug. 1, 2019.

Asset Management & Maintenance, "Management of Corrugated Steel Buried Structures", Dublin, Jun. 1, 2014 (Jun. 1, 2014), pp. 1-78, retrieved from the Internet: https://www.tiipublications.ie/library/AM-STR-06019-02.pdf, retrieved on Sep. 29, 2020.

Bertolini, N. et al., "Buses Metalliques: Guide Pour La Surveillance Specialisee, L'Entretien et la Reparation", Dec. 1, 1992 (Dec. 1, 1992), pp. 1-70, Retrieved from the Internet: http://dtrf.setra.fr/pdf/pj/Dtrf/0000/Dtrf-0000412/DT412.pdf, retrieved on Sep. 29, 2020.

Morel, Jean-Michel, "La reparation des buses metalliques", Mar. 1, 2012 (Mar. 1, 2012), Retrieved from the Internet: http://piles.cerema.fr/IMG/pdf/Reparation_buses_cle1ea4d1.pdf, retrieved on Sep. 29, 2020.

English Abstract of CN104213515 retrieved from www.espacenet.com.

"Welded Wire Mesh" Wikipedia, Wikimedia Foundation, accessed Dec. 30, 2021. https://en.wikipedia.org/w/index.php?title=Welded_wire_mesh&oldid=1062725935.

"Tunnel Construction" Johripur Steel and Alloys, 2019, accessed Feb. 14, 2022 http://www.johripur.com/tunnel-construction.html.

"Shear Force" Wikipedia, Wikimedia Foundation, accessed Feb. 3, 2022. https://en.wikipedia.org/w/index.php?title=Shear_force&oldid=1069594694.

Srivastava et al., "Flexural Strength Enhancement in Carbon-Fiber Epoxy Composites Through Graphene Nano-Platelets Coating on Fibers", Composites Part B: Engineering, vol. 179, Dec. 15, 2019—Abstract.

"Epoxy" Wikipedia, Wikimedia Foundation, accessed Feb. 18, 2022. https://en.wikipedia.org/w/index.php?title=Epoxy&oldid=1071746140%22.

Li et al., "Effects of Fiber and Matrix Properties on the Compression Strength of Carbon Fiber Reinforced Polymer Composites", New Carbon Materials, vol. 35, Issue 6, Dec. 2020, pp. 752-761—Abstract.

Longo et al., "Thermal and Seismic Capacity Improvements for Masonry Building Heritage: A Unified Retrofitting System", Sustainability 2021, 13, 111, Jan. 2021, 16 pages.

S&p: "Parament—und Gewölbesanierung mit S&P ARMO—crete d und S&P ARMO-mesh 200/200" Case study_2011, Jan. 1, 2015, Seiten 1-1, XP 055843998 <https://protect-us.mimecast.com/s/L14CCKr5OPi2vwjpruGEZFk?domain=sp-reinforcement.at>.

S&p: "FRCM Reforço de fibras de carbono em matriz cimenticia", Nov. 14, 2013, Seiten 1-95, XP055844144 <https://protect-us.mimecast.com/s/07LLCL95gQiRpOJ8YCrV0RG?domain=ordemengenheiros.pt>.

* cited by examiner

METHOD FOR RENOVATING, REPAIRING, REINFORCING, PROTECTING OR NEWLY CREATING CORRUGATED METAL-SHEET TUNNELS, AND CORRUGATED METAL-SHEET TUNNELS OF THIS TYPE

CROSS-REFERENCE TO RELATED APPLICATIONS

This application is a national stage entry of PCT/EP2019/058485 filed Apr. 4, 2019, which claims priority benefit to CH 00457/18 filed Apr. 10, 2018, each of which is expressly incorporated herein in its entirety.

FIELD

This invention concerns both the renovation, repair, reinforcement and the new construction of corrugated sheet metal tunnels, as such tunnels are mainly used for underpasses.

BACKGROUND

Bridges and passages for roads and waterways are necessary components of the road and waterway network. The maintenance of corrugated tunnels is a special technical challenge. Bendable, elastically embedded pipes made of corrugated sheet metal or corrugated steel pipes offer a construction system that proves to be ideal for numerous problems. Corrugated sheet metal tunnels were first used in the 1950s and offer a number of advantages:

- fast in preparation and construction,
- economical and with good corrosion protection durable and hardly sensitive to settling,
- existing corrugated sheet metal structures can be extended by connecting new prefabricated steel elements
- Ailing bridge structures or vaults can be rehabilitated by pulling in corrugated sheet metal structures without affecting the traffic above.

Corrugated steel structures are assembled on site from corrugated and curved steel plates, which have a plate thickness of 2.50 mm to 8 mm, using screw connections. Alternatively, the corrugated sheets can also be helically rolled with a steep thread pitch and then joined along their edges to form a pipe. Common shapes are circular profiles in cross section, mouth profiles of different height/width ratios, ellipses, circular and basket arcs. This corrugated sheet metal construction is then covered with gravel and then soil, for example as part of an embankment. Optimized corrugations are available for the corresponding application. Well-known applications are culverts for paths and watercourses, for example to cross elevations or dams, which are often used as road or railroad lines. In France alone, for example, there are 1073 such corrugated sheet metal tunnels under national surveillance, and 3000 to 4000 under surveillance by the individual departments.

In connection with completing construction elements such as steel walls, bends, supports, entrances, etc., it is also possible to construct economical piping of any length, rain retention and backwater channels, pipe collecting channels, escape tunnels or drainage tunnels in landfills in this way. The range of standard cross-sections is tailored to the various application conditions.

Most of these corrugated sheet metal tunnels have a diameter of between 1.5 m and 2.5 m, although larger diameters are also possible. In addition to the standard cross-sections, a large number of special profiles can be designed by changing the radii and opening angles in order to optimally adapt them to the application. The bends can thus be used to bridge existing railroad tracks or pipeline routes. The securing and renovation of old arched bridges and culverts during ongoing traffic using prefabricated steel elements has also proven its worth. Here, too, the profile can be optimally adapted to the cross-section of the vault.

In addition to the applications described above in road and bridge construction, corrugated sheet metal structures are also used in industry and agriculture. For example, the prefabricated steel parts are used to build gravel extraction tunnels, where heap heights of up to 25 m are possible, as well as silos, which are used for the storage of sand, gravel, crushed stone and similar materials. Discharge tunnels can include individual design details such as hopper inlets, change of inclination, pump sump, fastening for cables and similar. The tunnels can easily be dismantled after years of use and moved to another extraction site. Silos that require a simple foundation on ring foundations are constructed up to 12 m high and 16 m in diameter. Slurry tanks made of prefabricated corrugated sheet metal parts for farms are circular tanks that stand on a reinforced concrete slab, provided with a secure joint seal and special corrosion protection. These tanks are also suitable as service water tanks in industry.

Aged underpasses or other structures made of corrugated sheets may nevertheless show damage, be it due to the aging of the corrugated sheet, its corrosion, or be it due to the excessive mountain pressure or the high permanently acting load, or due to a temporary overload, or due to the abrasive effect of water flowing rapidly and permanently past the corrugated sheet elements in the case of a water channel made of such corrugated sheets. Further damage can occur as a result of natural subsidence of the terrain. In extreme cases, the tunnel profile may buckle, so that such a corrugated sheet metal tunnel is no longer accessible or drivable for safety reasons and must be closed. From the state of the art basic procedures for the renovation of corrugated iron tunnels are known. For example, D1: XP055605530 Management of Corrugated Steel Buried Structures as the next document on the state of the art shows a procedure in which the corrugated sheet metal is first cleaned, then anchoring elements are welded, screwed, riveted, glued or shot into the corrugated sheet metal. Then a layer of shotcrete is applied and roughly smoothed. One or more reinforcement nets of structural steel are inserted into this layer and then sprayed with shotcrete. Also D2: XP 055605503 Buses métalliques: Guide pour la surveillance spécialisée, l'entretien et la réparation by N. Bertolini et al., a method according to which reinforcing nets of mild steel are placed inside corrugated sheet metal tunnels and then covered with shotcrete. D3: XP055605556 La réparation des buses métalliques by Jean-Michel Morel also shows such a process. Similar processes can be seen in D4: CN 104 213 515 B, in D5: US 2009/214297 A and D7: U.S. Pat. No. 4,390,306 A, but none of them reveals the use of absolutely stainless and highly tensile reinforcing nets. Rather, conventional reinforcement nets made of structural steel are used, which, however, are excessively exposed to corrosion, especially in the case of water-bearing corrugated metal tunnels, and consequently a renovated corrugated metal tunnel will soon be in need of renovation again.

The task of the present invention is, in view of these facts, to specify a method for the efficient, rapid and inexpensive and sustainable rehabilitation, repair or reinforcement of such corrugated sheet metal tunnels, but also a method for the new construction of a corrugated sheet metal tunnel, whereby a longer service life of the structure, an increase in the load-bearing capacity or both should be ensured at low costs.

This task is solved by a procedure for the renovation, repair, reinforcement, protection or new construction of corrugated sheet metal tunnels, in which the inner or outer sides of the corrugated sheets are cleaned, then anchoring elements are welded, screwed or riveted onto the cleaned side of the corrugated sheets, are glued or shot in and a layer of shotcrete is applied to this cleaned side of the corrugated sheets until an externally smooth or coarsely smooth coating is obtained, and which is characterized in that one or more reinforcement nets in the form of carbon fiber nets with a mesh width of 15 mm to 20 mm are applied to this layer or and covering this or these reinforcement net(s) with a second layer of shotcrete or wet and/or dry sprayed mortar.

BRIEF DESCRIPTION OF THE FIGURES

On the basis of the drawings, the initial state of a corrugated sheet metal tunnel to be rehabilitated is shown and then the procedure for its rehabilitation is described and the function of the individual work steps is explained.

It shows.

DETAILED DESCRIPTION

Figure 1:
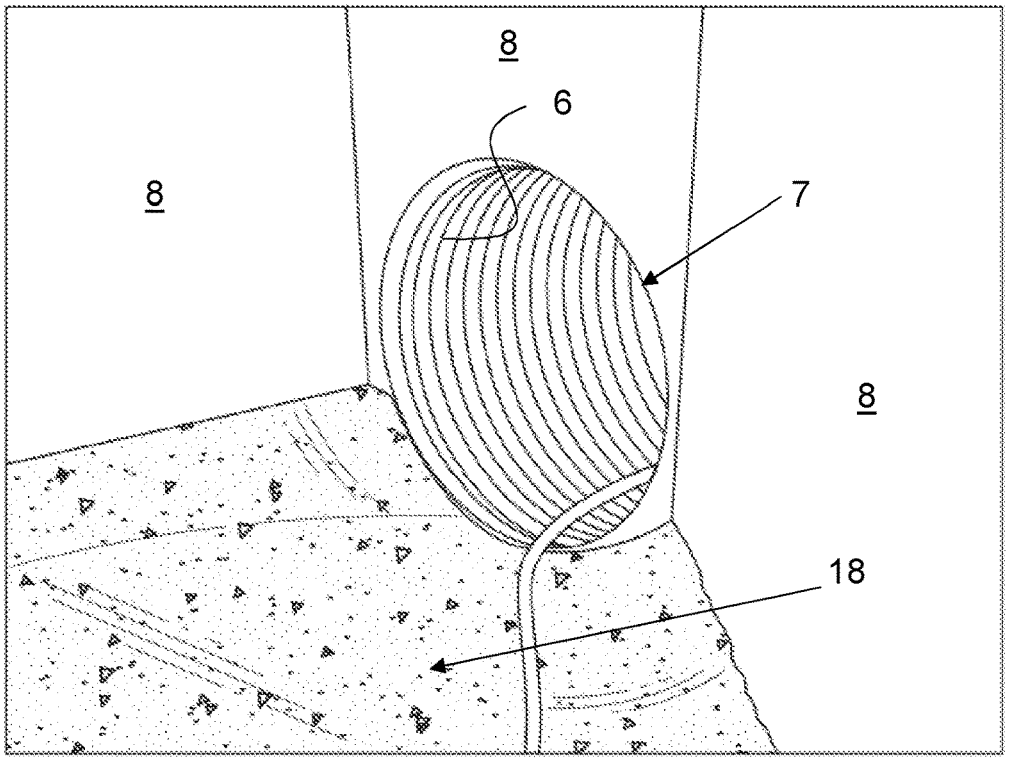
FIG. 1: The mouth of a completed corrugated metal underpass.

First, FIG. 1 shows an example of a finished corrugated iron underpass. The curved corrugated sheet metal formed into a pipe, with wave crests and wave troughs running along the circumference of the pipe, gives the tunnel the necessary stability. It absorbs the load of the weight above it, like two arches of a bridge. The upper semicircle of the pipe forms the first arch, and the lower semicircle of the pipe forms the lower arch. The pipe is surrounded on all sides by loose material.

Figure 2:
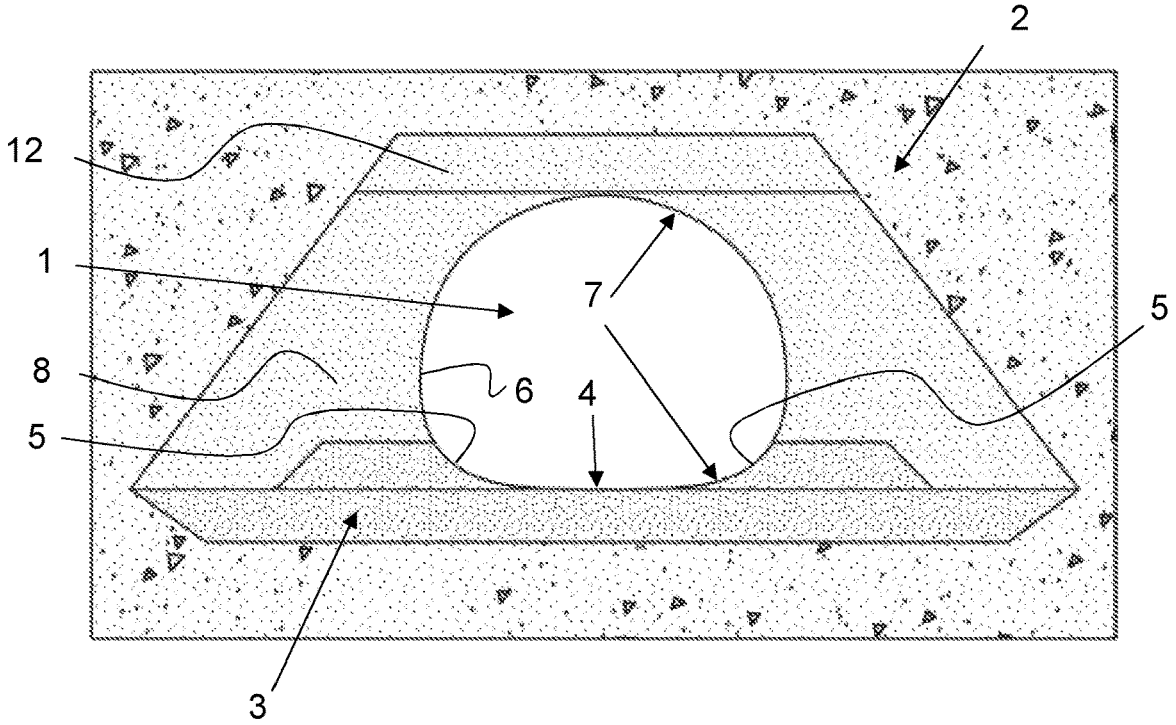
FIG. 2: A schematic cross-section of a corrugated sheet metal tunnel.

To understand the structure of such a corrugated metal underpass, a schematic cross-section through a corrugated metal tunnel is shown in FIG. 2. Typically, such passages lead through embankments for railroad lines, highway sections, etc., or other earth walls or dams, which are built over the corrugated sheet metal tunnels. First the corrugated sheet metal tunnel 1 is built, and then an embankment 2 is built over it. The cross-section of such a corrugated metal tunnel 1 looks like the one shown in FIG. 2. At the bottom, an artificial foundation 3 is first laid. This is shaped in such a way that it forms a canister 4 as a base and thus lateral support benches 5. Then the corrugated sheet metal 7 with the profile 7 shown here is laid in such a way that the wave crests run along the profile of the tunnel and the longitudinal axis of the tunnel is transverse to the waves. Individual corrugated sheet sections can be riveted, screwed or welded together. Corrugated sheet metal tubes can also be produced by winding corrugated sheets into a helix shape, in which case the adjacent longitudinal edges of the corrugated sheets are firmly connected to each other. They can also be slightly overlapped. Then the corrugated sheet profile 7 is gradually supported on both sides with a backfill 8. This creates a steep ramp on both sides, which reaches up to the height of the zenith of the corrugated sheet profile 7 or just covers it. A cover plate 12 is placed on top of the flat top of the ramp, for example made of concrete. This whole structure stabilizes the corrugated sheet profile 7 so that it cannot give way on any side, but is evenly loaded on all sides from the outside, similar to the arches of a bridge. On the outside around the structure, a fill 2 of earth is laid, for example a fill to form a dam, which is crossed by this tunnel.

Figure 3:
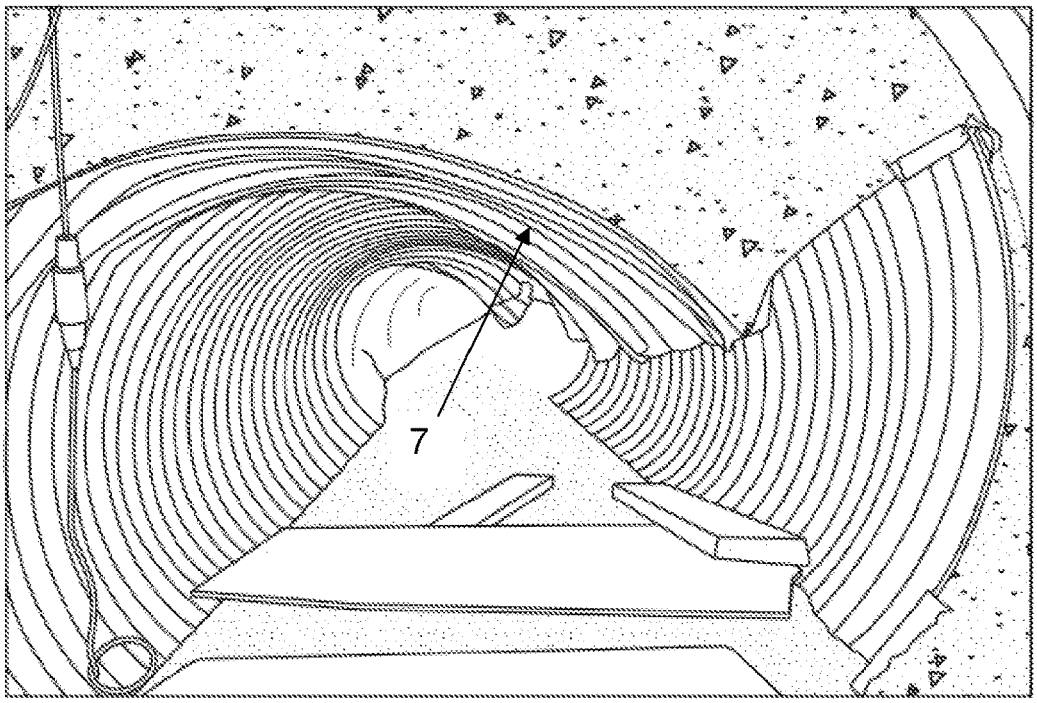
FIG. 3: A partially collapsed corrugated metal tunnel.

Over time, such a tunnel can be damaged. Excessive loading can deform the corrugated sheet profile 7 or, in the worst case, even cause it to collapse or collapse. FIG. 3 shows such a damaged tunnel with a partially depressed or collapsed corrugated sheet profile 7. Such a corrugated sheet profile 7 can be lifted again by means of hydraulic supports in the best case, but must then be reinforced to prevent it from collapsing again. With the present procedure, however, it is mostly a matter of reinforcing an intact existing corrugated sheet profile 7 of a tunnel in order to prevent deformation or collapse. Furthermore, the method also offers the possibility to make a newly built corrugated sheet metal tunnel much stronger by reinforcing the corrugated sheet metal profile on the outside or inside.

Figure 4:
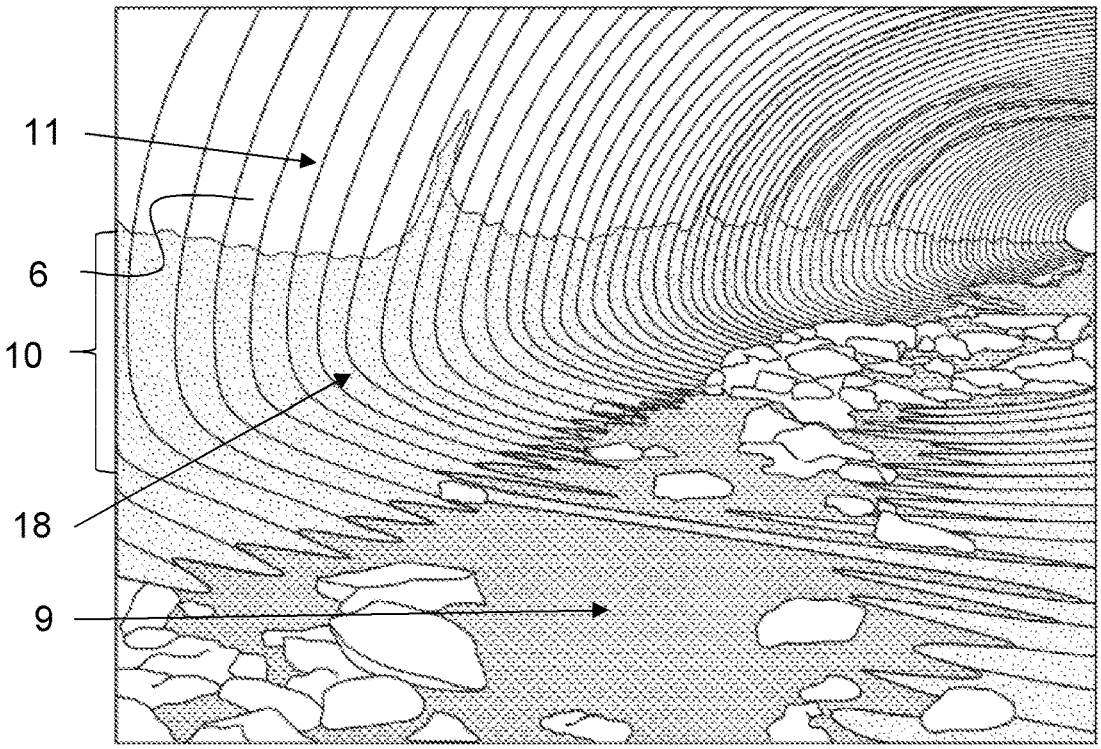
FIG. 4: A water-carrying corrugated sheet metal tunnel which is strongly corroded up to about one third of its height.

FIG. 4 shows another possible damage to a corrugated sheet metal tunnel. A water-bearing corrugated sheet metal tunnel 11 is shown here, whose corrugated sheet metal 6 has suffered greatly over time as a result of the flowing water 9. On the one hand, the corrugated sheet metal 6 is corroded in the lower third 10 of the height of the tunnel profile despite galvanization and on the other hand it is weakened in the lower area 10 by the constant abrasive effect of the water and the debris it carries, i.e. the wall thickness has been reduced there as a result of material removal. The corroded and weakened area is indicated by arrow 18.

Figure 5:
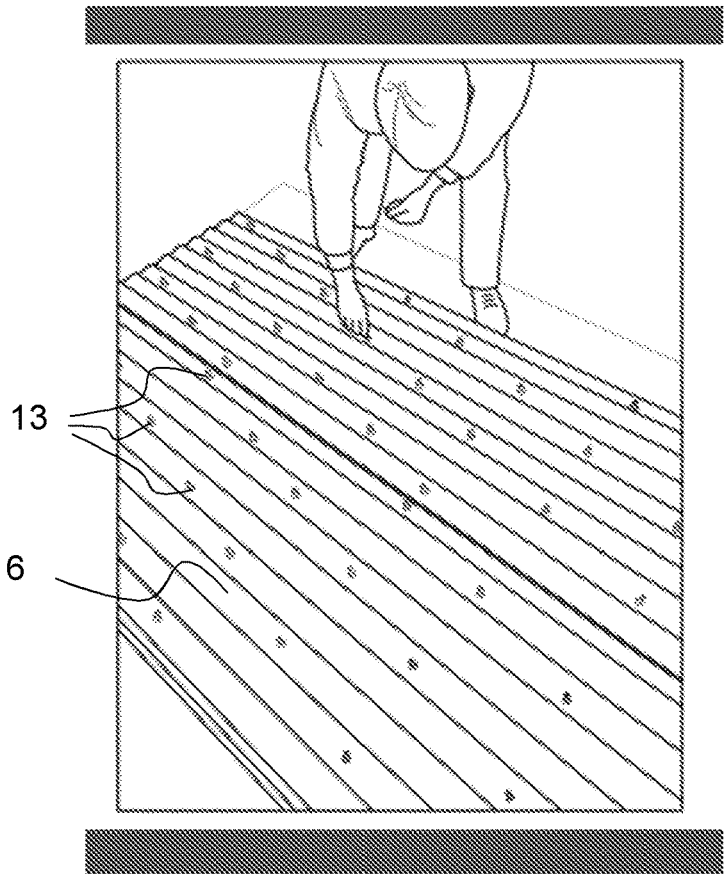
FIG. 5: The first step in the treatment of corrugated sheet metal for a reinforced corrugated sheet metal tunnel—the setting of shear connectors, shown here during a laboratory test.

To renovate a corrugated sheet metal tunnel, the corrugated sheet metal 6 to be reinforced is first sandblasted to clean it and remove any corrosion residues and also to make its surface rough. Then, as shown in FIG. 5, anchoring elements 13 are attached to the corrugated sheet metal by means of a laboratory test, for example in the form of shear bolts or cap screws or similar anchoring elements. In practice, this setting of anchoring elements 13 is usually done on site directly at the corrugated sheet metal tunnel, which is to be renovated, repaired or protected. These anchoring elements 13 are screwed, riveted, glued or welded onto the side of the corrugated sheet 6 to be reinforced, so that mushroom-shaped bolts protrude away from this corrugated sheet. With a special design of the bolts with a tip at the end and barbs at the side, such bolts can also be shot into the sheet metal with an appropriate gun, e.g. a gun operated with compressed air. Typically, about 4 to 8 or more such studs are set per square meter. The number of studs used depends on the thickness of the sheet metal and its curvature. The ultimate aim is to ensure the adhesion of the mortar applied afterwards by means of these anchoring elements 13 and also to ensure the attachment of a reinforcement mesh.

Figure 6:
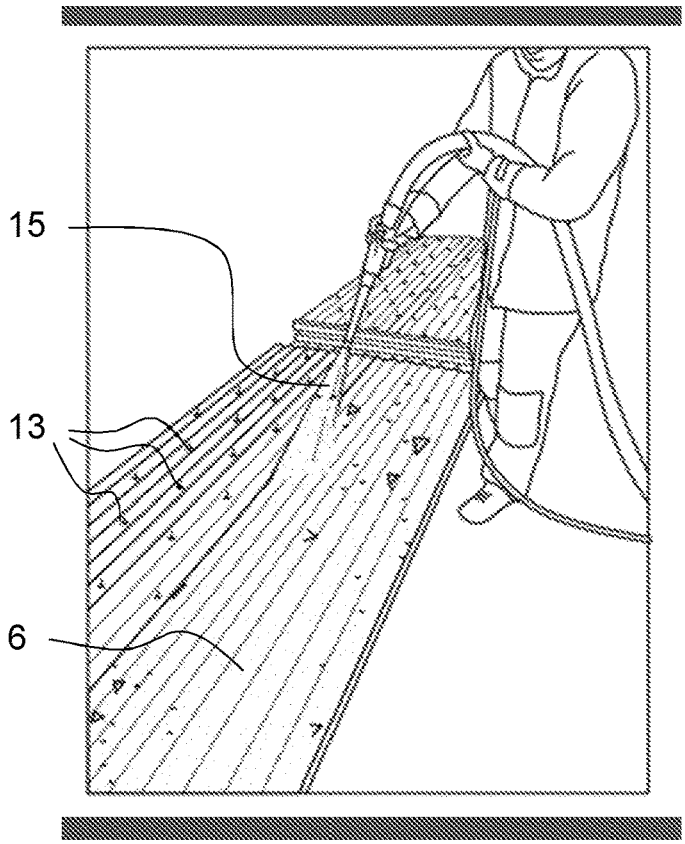
FIG. 6: The second step in the treatment of a corrugated sheet for a reinforced corrugated sheet tunnel—spraying a layer of shotcrete over the shear connectors, shown here during a laboratory test.
Figure 7:
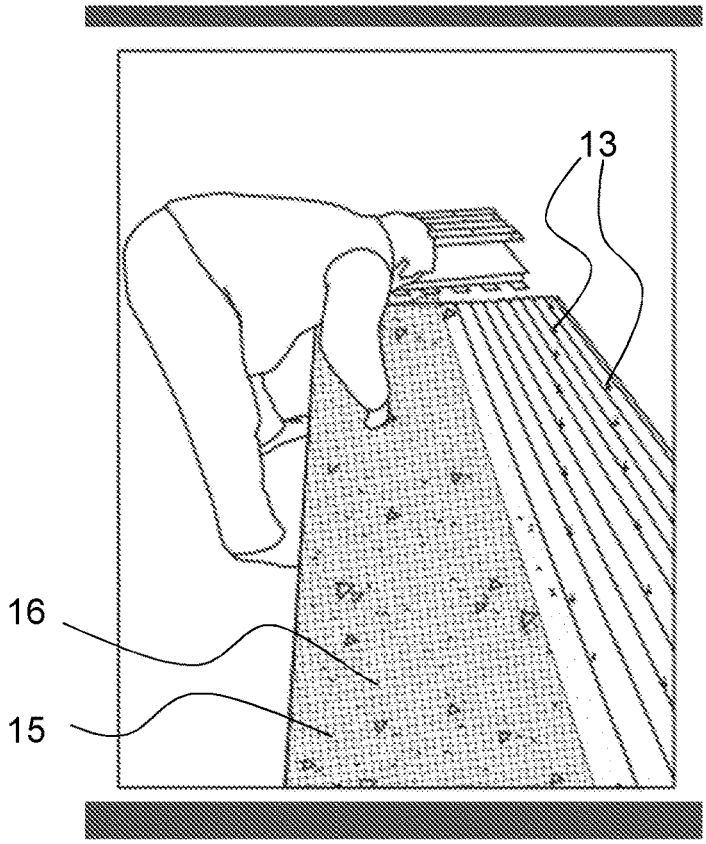
FIG. 7: The third step in the treatment of a corrugated sheet for a reinforced corrugated sheet tunnel—the application of a reinforcement mesh on the sprayed concrete layer, shown here during a laboratory test.

As FIG. 6 shows, in a second step the corrugated metal sheet 6 is sprayed with shotcrete 15 so that the anchoring elements 13, i.e. the bolts, protrude only slightly from the otherwise evenly applied concrete layer, also shown here in a laboratory test. In practice, the concrete layer is applied to the object or the wall of the corrugated metal tunnel on site. As shown in FIG. 7, in a further, third step at least one reinforcement net 16 is laid on top of the sprayed-on concrete layer 15, here also shown by means of an outdoor laboratory test, but in practice this is done directly on the object or on the concrete or mortar layer with anchoring elements 13 and a cover layer. If required, this reinforcement net 16 can be fixed to the bolt or screw heads or other anchoring elements 13. Several layers of reinforcement nets can also be used. A carbon fibre net, which for example has a density of 1790 kg/m$^3$, a modulus of elasticity of 240 GPa, a tensile force resistance over a width of 500 mm of 4300 GPa and an elongation at break of 1.75%, i.e. a break occurs after an elongation to 101.75% of the original length. Such nets are supplied in rolls. In FIGS. 5 to 7, these steps are shown here on a corrugated sheet 6 lying flat on the floor, as was done in a laboratory test. In practice, however, all these steps are carried out directly on the object, namely on the corrugated sheet tunnel. The sheets used are usually between 1.25 mm and 1.65 mm thick and available in sections of 2.50 m×0.80 m or smaller. Such corrugated sheets 6 can then be used to form a tunnel profile by connecting them to adjacent corrugated sheet sections. The flat sheets are used for the base. For the adjoining areas, curved sheets are prepared in the same way.

Figure 8:
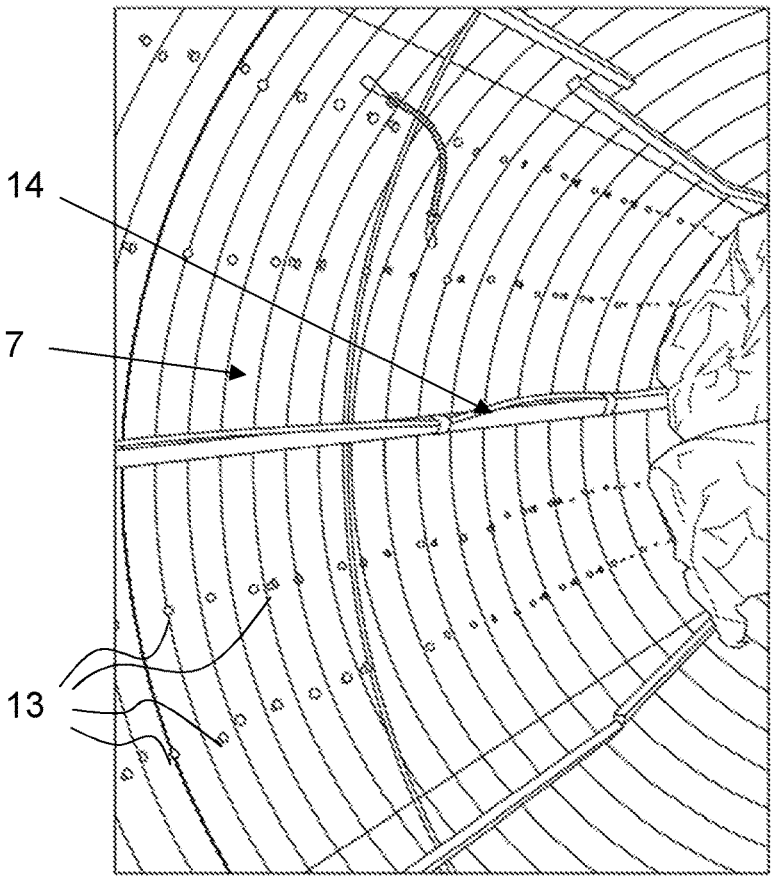
FIG. 8: A view of the inside of a corrugated metal tunnel with corrugated sheets fitted with shear connectors, shown here during a laboratory test.
Figure 9:
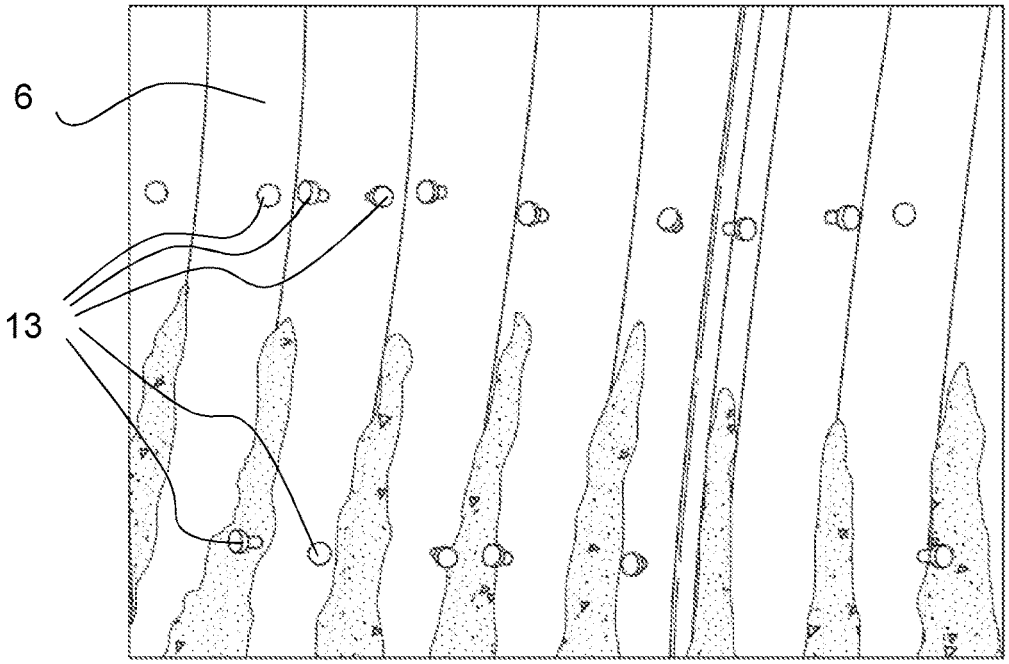
FIG. 9: A closer look at the inner side of these corrugated sheet tunnels with shear connectors.

FIG. 8 shows a corrugated sheet profile 7 of a tunnel, which was first equipped with anchoring elements 13 in the form of shear bolts or cap screws. FIG. 9 shows a view of the inner side of a corrugated sheet metal tunnel whose corrugated sheets 6 are equipped with anchoring elements 13 in the form of shear bolts. As shown here, these can easily protrude from the sheet in different directions—the main thing is that they just protrude from the sheet. They could also be all radially protruding.

Figure 10:
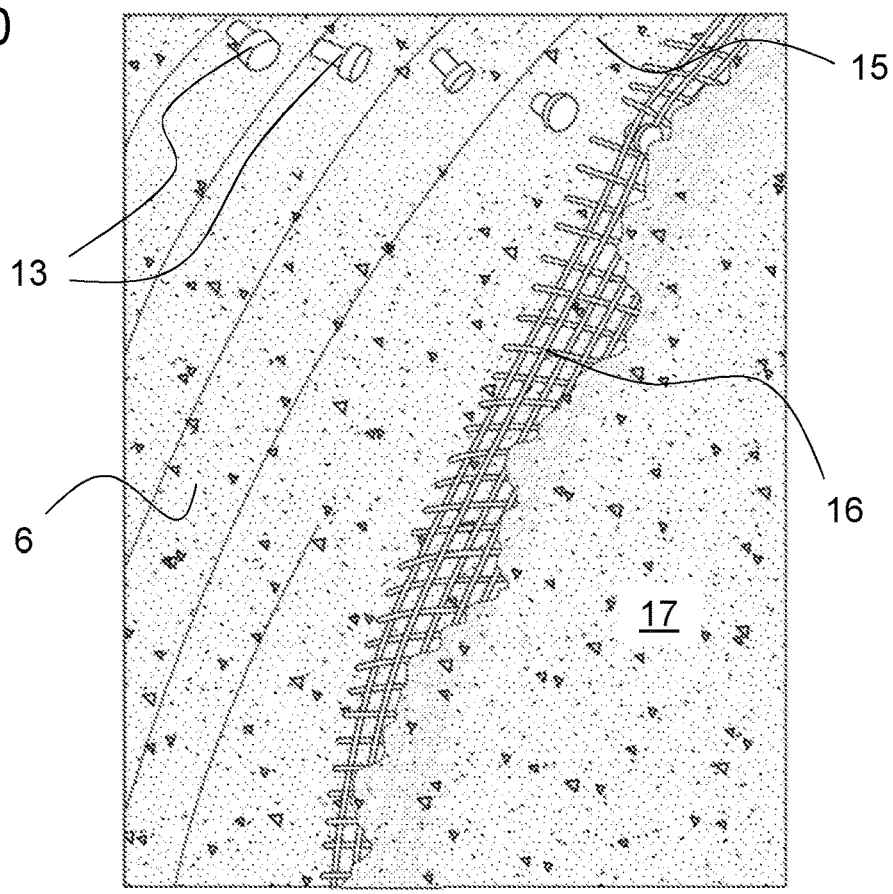
FIG. 10: A closer look at the inside of these corrugated sheet metal tunnels with the shear connectors protruding from the first layer of concrete, the reinforcing mesh and a second layer of shotcrete or wet sprayed mortar.

FIG. 10 shows a closer look at the inside of these corrugated sheet metal tunnels with shear connectors as anchoring elements 13. As can be seen here, a first layer of shotcrete 15 was sprayed onto the corrugated sheet metal, approximately so thick that a layer was created that was in principle smooth or coarsely smooth as far as the shotcrete would allow, extending over the crests and valleys of the corrugated sheets, and then the reinforcement net 16 was attached to the anchoring elements 13 protruding from the first layer of shotcrete. This reinforcement net 16 is preferably a carbon fiber net with a mesh size of 15 mm to 20 mm. The second layer 17 of shotcrete, approx. 15 mm to 20 mm thick, was sprayed on the right-hand side of the picture. This second layer of shotcrete can be smoothed out at the end. Instead of shotcrete, a wet shotcrete mortar can be used for this second layer, which is left raw for curing or can also be smoothed.

Figure 11:
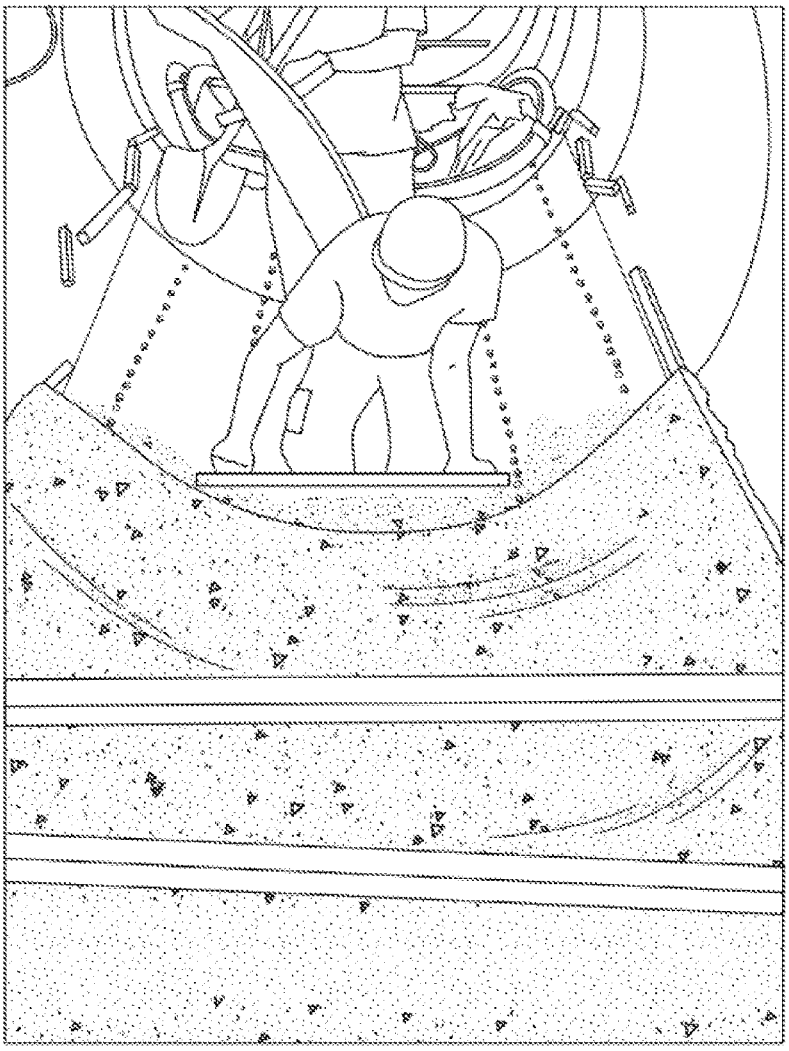
FIG. 11: Application of the top layer of shotcrete or wet sprayed mortar and smoothing of this top layer.
Figure 12:
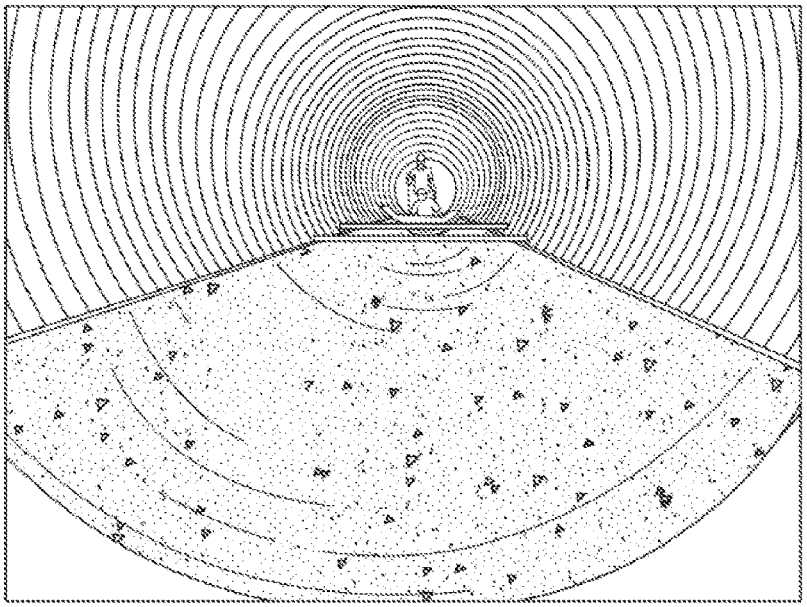
FIG. 12: A corrugated metal tunnel, the lower water-bearing side of which has been completely reinforced and renovated.

FIG. 11 shows how the top layer of shotcrete or wet sprayed mortar is applied and the smoothing of this top layer, which was created here in the lower area of the tunnel profile. And FIG. 12 shows a corrugated sheet metal tunnel whose lower, water-bearing side has been completely reinforced and renovated.

The reinforcement layer applied to the inside of a corrugated sheet metal tunnel as shown here considerably strengthens the corrugated sheet metal profile of a corrugated sheet metal tunnel. In the same way, a corrugated sheet metal profile can also be reinforced on its outside, during the construction of the corrugated sheet metal tunnel, if the corrugated sheet metal profile has not yet been filled in.

LIST OF NUMBERS

1 corrugated sheet tunnel
2 Backfill
3 Artificial foundation
4 Base
5 Lateral support benches
6 Corrugated sheet
7 Profile of the corrugated sheet tunnel
8 Lateral slope
9 Water flowing through the corrugated sheet tunnel
10 Lower third area of the corrugated tunnel
11 Water-bearing corrugated sheet metal tunnel
12 Concrete cover plate
13 Anchoring elements
14 Power lines
15 Shotcrete for first layer
16 Reinforcement mesh
17 Second layer shotcrete or wet mortar
18 Corroded, weakened area

The invention claimed is:

1. A method for renovating, repairing, reinforcing, protecting or newly constructing metal tunnels made of one or more bendable corrugated sheets of metal elastically embedded in fill, the tunnels having a cross-sectional shape of a circular profile or an elliptic profile, wherein the corrugated sheet of metal of the tunnel is curved and gives stability to the tunnel for absorbing a load of weight of the fill surrounding the tunnels in a manner of two arches of a bridge with an upper profile of the tunnel forming a first arch and a lower profile of the tunnel forming a lower arch, with one or more curved corrugated sheets of the tunnel having a thickness of between 1.25 mm and 1.65 mm or between 2.5 mm to 8 mm, wherein the method, regardless of whether only a section of the one or more corrugated sheets of the tunnel is reinforced and regardless of which section is reinforced, comprising:

welding, screwing, riveting, gluing, or shot-fitting anchoring means onto an inner side of the corrugated sheets;

applying a first layer of shotcrete, wet shotcrete mortar, and/or dry shotcrete mortar to the inner side of the one or more corrugated sheets to obtain a coating where the anchoring means project from the first layer;

laying one or more nets on the first layer and attaching the one or more nets with the anchoring means projecting from the first layer, wherein the one or more nets are in the form of carbon fiber reinforcing nets which are applied from rolls to the first layer when the first layer is still fresh or wet; and covering the one or more nets with a second layer of shotcrete, wet shotcrete mortar, and/or dry shotcrete mortar with a layer thickness of at least 10 mm.

2. The method according to claim 1, wherein the inner side of the corrugated sheets are cleaned and roughened by means of sandblasting, and the anchoring means including shear bolts or cap screws are welded, screwed, riveted, glued, or shot-fitted in a density of 4 to 20 pieces per square meter, wherein the one or more carbon fiber reinforcing nets have a mesh width of 15 mm to 20 mm, and the second layer is applied in the layer thickness of 10 mm to 30 mm.

3. The method according to claim 1, wherein upon application of the second layer, the second layer is smoothed or levelled on the one or more carbon fiber reinforcing nets.

4. The method according to claim 1, wherein the carbon fiber reinforcing nets have a density of 1790 kg/m$^3$, and the second layer is applied in the layer thickness of 10 mm to 30 mm.

5. The method according to claim 1, wherein the second layer is applied in the layer thickness of 15 mm to 20 mm.

6. The method according to claim 1, wherein the method is applied to the one or more corrugated sheets on the inner side in at least a lower third of the height of the tunnel profile.

7. The method according to claim 1, wherein a diameter of a tunnel profile is at least 1.5 m.

8. The method according to claim 7, wherein the diameter of a tunnel profile is between 1.5 m and 2.5 m.

9. The method according to claim 1, wherein a tunnel profile is being restored to its intact shape when the shape has been damaged, whereupon the inner side of the one or more corrugated sheets is cleaned before the anchoring means are welded, screwed, riveted, glued, and/or shot-fitted to the inner side of the one or more corrugated sheets.

10. The method according to claim 1, wherein the second layer has the layer thickness between 10 mm and 30 mm.

11. A corrugated sheet metal tunnel made of one or more bendable corrugated sheets elastically embedded in fill resulting from applying the method according to claim 8, wherein the one or more corrugated sheets are reinforced on the inner side in at least a lower third of a height of the tunnel profile by way of one or more carbon fiber reinforcing nets being attached to the anchoring means provided on the inner side of the one or more corrugated sheets.

12. The corrugated sheet metal tunnel according to claim 11, wherein the one or more carbon fiber reinforcing nets have a mesh width of 15 mm to 20 mm.

13. The corrugated sheet metal tunnel according to claim 11, wherein the second layer of shotcrete, wet shotcrete, and/or dry shotcrete mortar has the layer thickness of 10 mm to 30 mm.

14. The corrugated sheet metal tunnel according to claim 11, wherein the carbon fiber reinforcing nets have a density of 1790 kg/m$^3$, and the second layer is applied in the layer thickness of 10 mm to 30 mm.

15. The corrugated sheet metal tunnel according to claim 11, wherein the second layer is applied in the layer thickness of 15 mm to 20 mm.

16. The corrugated sheet metal tunnel according to claim 11, wherein a diameter of a tunnel profile is at least 1.5 m.

17. The corrugated sheet metal tunnel according to claim 16, wherein the diameter of a tunnel profile is between 1.5 m and 2.5 m.

18. The corrugated sheet metal tunnel according to claim 11, wherein the second layer has the thickness of between 10 mm and 30 mm.

* * * * *